US011708695B2

(12) United States Patent
Claeys

(10) Patent No.: US 11,708,695 B2
(45) Date of Patent: Jul. 25, 2023

(54) CURTAIN WALL

(71) Applicants: Stephanie Catharina R. Claeys, Zandhoven (BE); Laurens Leonard J. Claeys, Zandhoven (BE); Nausikaa Els P. Claeys, Zandhoven (BE)

(72) Inventor: Eric Claeys, Zandhoven (BE)

(73) Assignees: Stephanie Catharina R. Claeys, Zandhoven (BE); Laurens Leonard J Claeys, Zandhoven (BE); Nausikaa Els P. Claeys, Zandhoven (BE)

( * ) Notice: Subject to any disclaimer, the term of this patent is extended or adjusted under 35 U.S.C. 154(b) by 0 days.

(21) Appl. No.: 17/636,392

(22) PCT Filed: Aug. 20, 2020

(86) PCT No.: PCT/EP2020/073405
§ 371 (c)(1),
(2) Date: Feb. 18, 2022

(87) PCT Pub. No.: WO2021/032854
PCT Pub. Date: Feb. 25, 2021

(65) Prior Publication Data

US 2022/0290430 A1 Sep. 15, 2022

Related U.S. Application Data

(60) Provisional application No. 62/889,141, filed on Aug. 20, 2019.

(51) Int. Cl.
*E04B 2/96* (2006.01)

(52) U.S. Cl.
CPC ..... *E04B 2/965* (2013.01)

(58) Field of Classification Search
USPC ..... 52/204.5, 204.51, 204.7
See application file for complete search history.

(56) References Cited

U.S. PATENT DOCUMENTS 3,223,209 A * 12/1965 Skromeda ..... E04B 2/766 52/235
3,266,210 A * 8/1966 Grossman ..... E04B 2/96 52/690

(Continued)

FOREIGN PATENT DOCUMENTS

EP 0658662 A1 6/1995
KR 20130075240 A 7/2013

(Continued)

OTHER PUBLICATIONS

Eurasion Office Action in corresponding Eurasion Application No. 202290629, dated Sep. 28, 2022.

(Continued)

*Primary Examiner* — Joshua K Ihezie
(74) *Attorney, Agent, or Firm* — Bacon & Thomas, PLLC

(57) ABSTRACT

A curtain wall includes one or more vertically-extending mullions and one or more transoms, each extending horizontally between two mullions and having ends inserted in grooves of these two mullions. The curtain wall also includes at least an inwardly openable panel installed between two mullions, wherein a local adaptation of the two mullions adjacent to the openable panel comprises at least the removal of a laterally directed wall of the inner chamber of each of the two mullions along a height of the openable panel, and wherein the openable panel is installed in the local adaptation of the two mullions adjacent to the openable panel such that, when the openable panel is closed, the openable panel is not distinguishable from a fixedly fitted panel, neither from the inside nor from the outside of the curtain wall.

15 Claims, 8 Drawing Sheets

(56) References Cited

U.S. PATENT DOCUMENTS

| | | | | |
|---|---|---|---|---|
| 3,548,558 | A * | 12/1970 | Grossman | E04B 2/965 52/235 |
| 4,537,000 | A | 8/1985 | Gartner | |
| 8,800,221 | B1 * | 8/2014 | Header | E04B 2/88 52/220.8 |
| 2014/0247475 | A1 * | 9/2014 | Parker | E06B 3/66328 359/275 |
| 2017/0040940 | A1 * | 2/2017 | Ting | E04B 2/965 |
| 2018/0090992 | A1 * | 3/2018 | Shrivastava | H02J 50/20 |
| 2019/0085618 | A1 * | 3/2019 | Al Kassas | E04B 2/90 |
| 2019/0267840 | A1 * | 8/2019 | Rozbicki | H02J 50/30 |
| 2021/0262230 | A1 * | 8/2021 | Golan | E04F 13/0869 |

FOREIGN PATENT DOCUMENTS

| | | | |
|---|---|---|---|
| WO | 2010122593 | A1 | 10/2010 |
| WO | 2017201587 | A1 | 11/2017 |
| WO | 2017201588 | A1 | 11/2017 |
| WO | 2017201589 | A1 | 11/2017 |

OTHER PUBLICATIONS

ISR and Written Opinion in corresponding PCT Application No. PCT/EP2020/073405, dated Nov. 2, 2020.
Second Written Opinion in corresponding PCT Application No. PCT/EP2020/073405, dated Jul. 9, 2021.
International Preliminary Report on Patentability in corresponding PCT Application No. PCT/EP2020/073405, dated Nov. 25, 2021.

* cited by examiner

CURTAIN WALL

FIELD OF THE INVENTION

The present invention relates to curtain walls or curtain walling.

BACKGROUND

A curtain wall is a structure of mullions and transoms in which panels, usually glass panels, but possibly also dense panels, are placed in order to form an external wall of a building.

A drawback of the known curtain walls, for example of the curtain wall known from KR 20130075240, is the fact that the mullions and transoms are designed in such a way that they have to be built up from outside to form a structure of profiles. Also, the panels subsequently have to be installed from the outside. Especially when this has to be carried out at a height, this is complicated and requires scaffolding or suspended working platforms and is dangerous for the people doing this work and for the people situated underneath.

Moreover, the known systems of mullions and transoms require a large number of components and a large number of operations to assemble them.

A curtain wall structure is known from U.S. Pat. No. 3,266,210 with transoms which are mounted between the mullions. In this known structure, the transoms are clicked into place in the mullions, which has the disadvantage that the transoms can also click loose again undesirably. Another important disadvantage of this known structure is that it does not offer a solution for the problem of tolerances. With a curtain wall there are two different kinds of tolerances, on the one hand the manufacturing tolerances as a result of the limitations in connection with the accuracy in production, and on the other hand the installation tolerances as a result of installation in situ. The manufacturing tolerances comprise both the extrusion tolerance and the tolerance in further processing of the particular profiles. In addition, the transoms should be mounted between the mullions with a clearance at their ends to allow for compensating for, on the one hand, the thermal expansion of the transoms, and on the other hand, the differential settlement of a building, which is unavoidable and is typical of a concrete or steel basic shell structure. However, this has the result that the connection between the mullions and transoms is not waterproof, which may give rise to leaks, which is obviously inadmissible for a façade.

The curtain wall structure in US'210 is not very versatile. It only allows working with panels of one predetermined thickness, such as glass panels.

A curtain wall is known from WO 2017/201588 wherein the connection between the transom and the mullion forms a barrier to water, so that water which penetrates into the chambers of the mullions, for example via the rubber seal against which the window is fitted, can be carried off to the transom and be removed to the outside there. In addition, the system from WO'588 allows working with panels of different thicknesses, such as glass panels, by choosing suitable glazing beads that hold the panel in question in place along the inside of the curtain wall. The curtain wall in WO'588 can be installed from inside the building.

SUMMARY

The present invention relates firstly to an alternative curtain wall which, according to various preferred embodiments, offers a solution for one or more problems of the curtain walls from the prior art.

For this purpose, the present invention relates to a curtain wall which is characterized by the fact that the abovementioned curtain wall comprises at least an inwardly openable panel, more particularly a window. This inwardly openable panel preferably comprises, but is not limited to, at least one of the following embodiments: a tilt window with a handle, a tilt window without a handle, suitable to be operated by means of an actuator, a turn window, a tilt/turn window or a parallel inwardly opening window.

With the prior-art curtain walls, it is possible to install outwardly openable panels and other panels which open in a less aesthetically pleasing manner, but in particular windows. The present invention offers a long-awaited technical solution for outwardly openable panels in a curtain wall. Preferably, the abovementioned curtain wall furthermore comprises at least one fixedly fitted panel, more particularly a window.

Preferably, the abovementioned curtain wall comprises one or more mullions and one or more transoms. The most important embodiment involves a curtain wall of the continuous type, namely a curtain wall which is constructed from mullions (vertical profiles or mullions) and transoms (horizontal profiles), wherein at least the mullions or at least the transoms extend along several of the abovementioned panels, either fixedly fitted or openable.

Preferably, the abovementioned mullions are composed of at least an inner profile and an outer profile connected by means of one or more plastic profiles, wherein at least the inner profile consists, for example, substantially of steel or aluminium.

Preferably, the mullions are substantially configured such that the edges of any fixedly fitted panels are at least inserted in the mullions, wherein the one or more mullions extend vertically and are provided, on two opposite sides, with a groove with an access opening, which grooves form a rebate in which the lateral edge of an aforementioned fixedly fitted panel is arranged, wherein the one or more transoms extend horizontally between two mullions and their ends are inserted, for example, in the abovementioned grooves of these two mullions.

Preferably, one or more of the abovementioned mullions are locally adapted for fitting an inwardly openable panel, i.e. openable towards the inside of the building. Preferably, the respective mullion comprises an inner chamber on the inside of the curtain wall, and wherein the abovementioned local adaptation comprises at least the removal of a laterally directed wall of the abovementioned inner chamber.

Preferably, the abovementioned adaptation offers space for fitting an openable frame in which or on which a glazing is fixedly fitted.

Preferably, the outer side of the openable panel, more particularly the glazing of an openable window, is situated in the same or virtually the same plane as the outer side of a fixedly fitted panel, more particularly as the glazing of a fixedly fitted window.

Preferably, the abovementioned transom is also composed of at least an inner profile and an outer profile connected by means of one or more plastic profiles.

In some embodiments, the abovementioned transom comprises an actuator for automatically opening and/or closing the respective openable panel. In this case, this may be a chain actuator, such as an actuator of the rigid chain actuator-type, also known as "linear chain actuator", "push-pull chain actuator", "electric chain actuator" or "column-forming chain actuator", but other actuators are not excluded.

Preferably, the respective actuator is incorporated in the transom which is situated on the top side of the openable profile. Preferably, the respective openable panel which is operated by means of the actuator is a tilt window without a handle.

According to the most preferred embodiment, the curtain wall relates to a curtain wall with mullions and transoms which, in addition, have the properties of one or more of the claims from WO'588, WO 2017/201587 (WO'587), WO 2017/201589 and/or the preferred embodiments thereof, for instance a curtain wall (1) which comprises mullions (5), transoms (14) and one or more panels (4), wherein the mullions (5) extend vertically, wherein the transoms (14) are each attached to two mullions (5) and extend horizontally, wherein the mullions (5) are provided with a groove (9, 10) on each side for receiving the lateral edge (33) of a panel (4), wherein the grooves (9,10) have an access opening (12), wherein the access opening has a first fixed dimension or width (A1) in the horizontal direction, wherein the transoms (14) have a second dimension (A3) in the horizontal direction and at right angles to the profile direction of the transoms (14), wherein the second dimension (A3) is greater than the first dimension (A1), wherein the transoms (14) have a third dimension (A4) in a non-horizontal direction at right angles to the profile direction, wherein the third dimension (A4) is smaller than the first dimension (A1), preferably but not necessarily characterized in that the transoms (14) are provided with an undercut groove (30) which runs in the profile direction and with a rod (32) inserted in the undercut groove (30), wherein the mullions (5) are provided with a second groove (13) for receiving an end of said rod (32) projecting beyond the undercut groove (30), thereby blocking a rotational movement of the transoms (14), wherein the bracketed reference numerals used here refer, without limitation, to the figures of WO'588, and/or a curtain wall (1) which comprises one or more mullions (5), one or more transoms (14) and one or more panels (4), wherein the one or more mullions (5) extend vertically, wherein the one or more transoms (14) are attached at right angles to the one or more mullions (5), wherein the one or more transoms (14) and the one or more mullions (5) define rectangular openings, wherein the one or more panels (4) are placed in said openings in order thus to close these openings, wherein the panels (4) are inserted by their lateral edges (33,39,44) in a rebate (11,34) of the mullions (5) and of the transoms (14) with the aid of seals (35), characterized in that the rebates (11) in the mullions (5) have a fixed indivisible width (A1) and in that the one or more panels (4) are secured along the inside of the curtain wall (1) in the mullions (5) by means of first glazing beads (34) which are made from a rigid material and are provided with an abovementioned seal and which are attached to a said mullion (5) by means of first attachment aids (36), wherein the first attachment aids (36) and the one or more of said mullions (5) are designed to be able to attach the first attachment aids (36) to a said mullion (5), wherein the first attachment aids (36) and the first glazing beads (34) are designed to be able to attach or fix, e.g. to click-fit, the first glazing beads (34) to the first attachment aids (36), preferably but not necessarily in a direction parallel with the plane of the respective panel (4), wherein the bracketed reference numerals used here refer, without limitation, to the figures of WO'587, and/or a curtain wall (1) which comprises one or more mullions (5) and one or more transoms (14) and panels (4) which are inserted by their edges (33,39,44) in the mullions and in the transoms, wherein the one or more mullions (5) extend vertically and are provided, on two opposite sides, with an undercut groove (9,10) with an access opening (12) with a fixed width (A1), which grooves (9,10) form a rebate in which the lateral edge (33) of an aforementioned panel (4) is inserted, wherein the one or more transoms (14) extend horizontally between two mullions (5) and are inserted with their ends in the abovementioned grooves of these two mullions, wherein a seal (28,29) is provided on these ends of the transoms (14) which forms a barrier to water, wherein the barrier is designed to carry this water off to a said transom (14) and wherein the transoms (14) are designed to carry this water away to the outside of the curtain wall (1), wherein the bracketed reference numerals used here refer, without limitation, to the figures of WO'589.

Preferably, the abovementioned inner profile of the mullion at least partly forms an undercut of the abovementioned groove, wherein, preferably, at least one attachment aid is fitted in the abovementioned undercut in order to attach one or more glazing beads thereto in order to secure a fixedly fitted panel or window. The attachment aid may be made of plastic, preferably of a thermoplastic, for example of polyvinyl chloride. Thermoplastics can be shaped easily by means of, for example, extrusion or injection-moulding.

Preferably, the groove formed in the lateral edge of the mullion has an elongate cross section which is configured with a rounded section at one or more of the transverse ends and/or is free from roundings with a radius smaller than 2 millimetres at one or more of the transverse ends, or is even free from roundings with a radius smaller than 5 millimetres. The fact that one or more of the transverse ends of the undercut groove are configured to have a rounded section or roundings of 2 millimetres or more, or even of 5 millimetres or more, can result in various advantages. With such a geometry of the undercut groove, it is for example easier to achieve a fully or partly waterproof connection between the abovementioned transoms and the mullions than is the case with an undercut groove having a rectangular cross section. In the latter case, it is difficult to achieve a water seal at the location of the corners.

Preferably, on at least one, and preferably on both, of the ends of the transoms, a head piece is provided that comes into contact with one or more of the aforementioned transverse ends of the groove formed in the lateral edges of the mullion. At the location of said contact, there is preferably compression of the material of the head piece. Through deformation of the material of the surface of the head piece, a watertight and/or airtight connection may be obtained between the transom and the mullion, even with a difference in geometry between the head piece and the respective transverse end, for example due to tolerances. Preferably, the head piece consists completely, or at least on the surface thereof where the connection is to be formed, of a material which is more easily compressible or softer than the material of the aforementioned transom. The head piece preferably consists of a separate portion that is attached to the end of the respective transom.

Preferably, the connection between the transom, more particularly the head piece fitted thereon, and the mullion, more particularly the groove formed in the lateral edge thereof, is produced exclusively by mechanical means, namely by positioning the transom, more particularly the head piece, in the groove. Preferably, the aforementioned connection is disconnectable and reconnectable. The aforementioned connection is thus preferably free from adhesives, or other fastening means, such as sealant kit. As mentioned above, the connection of the head piece and the groove preferably provides a seal at the connecting point between the transom, more particularly the head piece, and the mullion, more particularly the groove formed in the lateral edge thereof.

It is clear from the foregoing that a seal which forms a barrier to water is preferably provided on the aforementioned ends of the transoms. Here, the aforementioned barrier preferably comprises at least one seal of the aforementioned groove, wherein this seal is formed at least partially by the aforementioned head pieces, and more particularly by the contact of the aforementioned head pieces with one or more of the transverse ends of the groove formed in the lateral edge of the mullion. Preferably, said seal is achieved by connecting the head piece in question with all walls of the aforementioned groove. In other words, the shape of the head piece is preferably adapted in such a way that it forms a contact over both complete transverse ends, and over the innermost transverse wall of the groove.

It should be noted that a seal on the connecting points between transoms and mullions may lead to control of infiltration water per individual façade section or panel, namely a so-called field effect. When all connecting points between transoms and mullions surrounding a façade section are sealed, preferably at least by means of contact between the respective head piece and the groove, a so-called field effect may be obtained. This field effect allows simple detection, more particularly localization, of the cause of water seeping inwards. Such seeping is, with a field effect, namely due to a leak present in the relevant façade section, and not from façade sections adjacent or above, in contrast to traditional curtain walls in which infiltration water is collected over several façade sections in the mullions and is carried away. It is clear that leaks in façade sections and the risk of water seeping inwards must be minimized as far as possible and even prevented.

Preferably, the water from the mullions is carried away via one or more openings made in the transom, wherein these openings are preferably located at a distance from the mullions, for example at a distance of between 10 and 300 mm. In this way, discharge of water per panel or façade section may be achieved. As mentioned above, such drainage is advantageous in order to detect the cause of any water leaking inwards. Of course, water leaking inwards is undesirable and should definitely be prevented. With such an embodiment, no discharge for water needs to be provided in the mullions, and any infiltration water in the curtain wall is carried away to the outside per façade section.

Preferably, in the cases wherein the head piece is fitted as a single-part or multi-part, but separate, portion over the end of the transom, a sealing fastening means is fitted between the aforementioned head piece and the relevant transom. The sealing fastening means may for example be an elastic or plastic sealant kit and/or a fastening means based on silicone, a relatively liquid butyl sealant or similar. This will prevent water which is located on the transom from finding its way between the head piece and the transom, for example as a result of small deformations of the head piece.

As mentioned above, one or more attachment aids for fastening glazing beads are preferably adhesively bonded in at least one of the aforementioned transverse ends, preferably in the transverse end which is situated on the inside of the curtain wall. Adhesively bonding the attachment aids makes it possible to simplify the geometry of the mullions, in comparison with the mechanical connection from the prior art, for example WO 2017/201587. In the case wherein the head pieces on the transoms are fitted into the groove of the mullions by means of a rotating motion, this is achievable without locking elements of a mechanical connection forming an obstruction.

Preferably, the aforementioned attachment aids are adhesively bonded in undercuts of the aforementioned groove. Preferably, the aforementioned first glazing beads are each fastened by means of several first attachment aids positioned at a distance from one another along the mullion. As stated above, adhesive bonding of the attachment aids may lead to a simpler design of the mullions. This simpler design may be configured so that the cavities in the mullion are easier to seal, for example by means of the ends or head pieces of the transoms, such as may be the case with the mullions and the groove in the lateral edge thereof.

It should furthermore be noted that fastening each of the aforementioned first glazing beads by means of several first attachment aids positioned at a distance from one another along the mullion is also advantageous in the case in which the attachment aids are fastened to the mullions by means of mechanical locking, or in other words in the case in which the attachment aids are click-fitted.

Preferably, the attachment aids have a surface with one or more ribs. These ribs preferably form a surface that is easier to adhesively bond in the aforementioned transverse ends of the groove. The tops of these ribs preferably come into contact with the surface of one of the aforementioned transverse ends of the groove, whereas there is space for receiving glue or some other cured fastening means between two adjacent ribs. The transverse ends of the groove as such are preferably free from large irregularities, such as ribs, so that a good sealing is still possible at the fastening points between transom and mullion on the basis of the aforementioned head pieces.

Preferably, the curtain wall of the invention furthermore has the features that the aforementioned grooves in the lateral edge of the mullion have an access opening, wherein the access opening has a first fixed dimension or width in the horizontal direction, wherein the transoms have a second dimension in the horizontal direction and at right angles to the profile direction of the transoms, wherein the second dimension is greater than the first dimension, wherein the transoms have a third dimension in a non-horizontal direction at right angles to the profile direction, wherein the third dimension is smaller than the first dimension, so that the ends of the transoms, in a rotated state of the transoms in which the direction of the third dimension is horizontal, pass through the access opening and wherein the transoms are provided with a locking element, for example in the form of a movable rod, wherein the mullions are provided with a locking groove for receiving a portion of the aforementioned locking element, for example a portion of said rod, so as thus to block a rotational motion of the transoms. The presence of a lock for the transoms increases the structural stability of the curtain wall at greatly increased temperatures, such as in case of a fire.

The foregoing makes it clear that the curtain walls of the invention may be configured in such a way that they can be installed from the inside of a building without requiring an excessive number of operations. For example, in a position state when rotated about their longitudinal axis, the transoms may be placed in the access openings and then by rotation they receive their desired orientation and are fixed or click-fitted in the undercut grooves, wherein an airtight and/or watertight seal of the undercut groove is preferably achieved. During construction of the curtain wall, the transoms may be secured by means of the locking element and the locking groove. For example, with a simple displacement of a locking element, for example a rod or strip, sufficient locking may be achieved against loosening of the transoms fitted between the mullions.

Preferably, the inner profile, the plastic profile and the outer profile are securely fastened to each other, and are preferably not disassemblable from one another, preferably so that the width of the aforementioned access opening has a fixed dimension. The relevant mullions extend from the inside of the curtain wall to the outside of the curtain wall and perform all functions that a mullion from the prior art, erected from outside, may have, namely thermal break, drainage per façade section and the like. It is clear that the mullions are preferably prefabricated, wherein most of the part-profiles which are fastened to one another are already fastened to each other before the curtain wall is installed at the construction site. Preferably, the mullions on the one hand and/or the transoms on the other hand are delivered to the construction site as a fixedly connected whole. The possibility of working with a prefabricated mullion, with which drainage per façade section may nevertheless be achieved, is unique and, according to preferred embodiments, the curtain wall of the present invention can offer an ideal solution for this.

Preferably, an airtight and/or watertight seal is obtained at the fastening points between transoms and mullions, for example exclusively by means of the aforementioned contact between the optional head pieces on the transom and the groove in the lateral edge of the mullion.

In a preferred embodiment, one or more walls of the grooves are provided with a recess in which a portion of the transoms is situated, wherein the transoms are supported vertically by a bottom edge of said recess. The aforementioned recess preferably extends in the horizontal direction through one or more of the transverse walls that delimit undercuts of the aforementioned groove. This is an easy way of achieving fastening of the transoms to the mullions without additional fastening pieces. In addition, this kind of suspension allows the transoms to have some clearance in their profile direction, which is desirable in order to be able to absorb stresses in the curtain wall. The transoms "hang" in this recess and are preferably supported on the mullion both at the front side and on the inside. In this way, the loads on the transoms are transmitted to the mullions.

The aforementioned recess may be formed in the mullions by milling out, punching out or cutting out.

Preferably, the abovementioned locking groove containing the locking element, for example the rod, for blocking the rotation of the transoms is arranged on the inside of the second leg. This facilitates sliding of the rod from the inside when constructing the curtain wall, in other words from a floor against which the curtain wall is fitted.

Preferably, said grooves have a different depth on the different sides of the mullions. This makes it possible for the panels also to be fitted from the inside, by placing a panel in the deepest groove at an angle, then moving it to the desired orientation and then sliding it towards the shallow groove.

Preferably, the panels are glass panels. According to a particular embodiment, the panels are so-called "smart glazing" panels, namely glass panels whose transparency, reflection, heat transfer or other properties can be regulated on the basis of electronic signals.

It is clear that the outside of the curtain wall is the side that is exposed to atmospheric effects.

As mentioned above, in horizontal cross section the grooves preferably have undercuts and, not counting their access opening, preferably have an elongate shape wherein the transverse ends preferably have a rounded section or are configured with roundings of 2 millimetres or more.

In a further preferred embodiment, the transoms and the mullions define rectangular openings, wherein one or more panels are placed in said openings, thereby closing these openings, wherein the one or more panels are fixed by means of first glazing beads, which are fastened to a said mullion by means of first attachment aids, wherein the first attachment aids and the mullions are configured so as to be able to fasten the first attachment aids to a said mullion, preferably as stated above by fixedly gluing it in the aforementioned undercut groove or by fixedly click-fitting it by means of mechanical locking elements, wherein the first attachment aids and the first glazing beads are preferably configured so as to be able to attach or fix, e.g. click-fit the first glazing beads to the first attachment aids. In this way, first glazing beads may be fastened easily, e.g. simply but not only by click-fitting. This makes it possible to fit the panels from the inside. As mentioned above, several attachment aids are preferably used, spaced apart along the mullion.

According to an alternative to fixing the attachment aids by gluing, or in combination therewith, the first attachment aids and said mullions may be configured so as to be able to click-fit the first attachment aids to a said mullion in a direction at right angles to the plane of the panel in question, wherein the first attachment aids and the first glazing beads are configured so as to be able to attach or fix, e.g. click-fit the first glazing beads to the first attachment aids, for instance but not only in a direction parallel to the plane of the panel in question. Preferably, however, the attachment aids are only attached to the mullion by adhesive bonding. The fitting of the attachment aids to the mullions may be carried out before mounting the respective mullion, for example as a component of a prefabricated mullion, delivered as such on site. It is, however, also possible for the attachment aids to be fixed on the mullions after mounting the mullions, for example in connection with installing the panels and/or the glazing beads.

In another preferred embodiment, the one or more said mullions and the first glazing beads are configured so that the first glazing beads rest against the mullion, on their side turned away from the panel in question.

In another preferred embodiment, the one or more panels are fixed by means of second glazing beads which are attached to a said transom by means of second attachment aids, wherein the second attachment aids and the one or more said transoms are configured in such a way that the second attachment aids can be fixed to a said transom, wherein the second attachment aids and the second glazing beads are configured so that the second glazing beads can be attached or fixed, e.g., but not only, click-fitted to the second attachment aids. The advantages mentioned in connection with the first glazing beads and the mullions are thus also applicable to the transoms and the second glazing beads. It is clear that the attachment aids for the second glazing beads can be fixed to the transoms in a similar way as the attachment aids for the first glazing beads are fixed to the mullions.

Preferably, the first and/or the second attachment aids are made of plastic, such as PVC (polyvinyl chloride), PP (polypropylene), PA (polyamide), PE (polyethylene), PET (polyethylene terephthalate), and the first glazing beads are preferably made of aluminium.

DETAILED DESCRIPTION

In order to show the features of the invention in more detail, some preferred embodiments are described below by way of example and without being limiting in nature, with reference to the accompanying drawings, in which.

Figure 1:
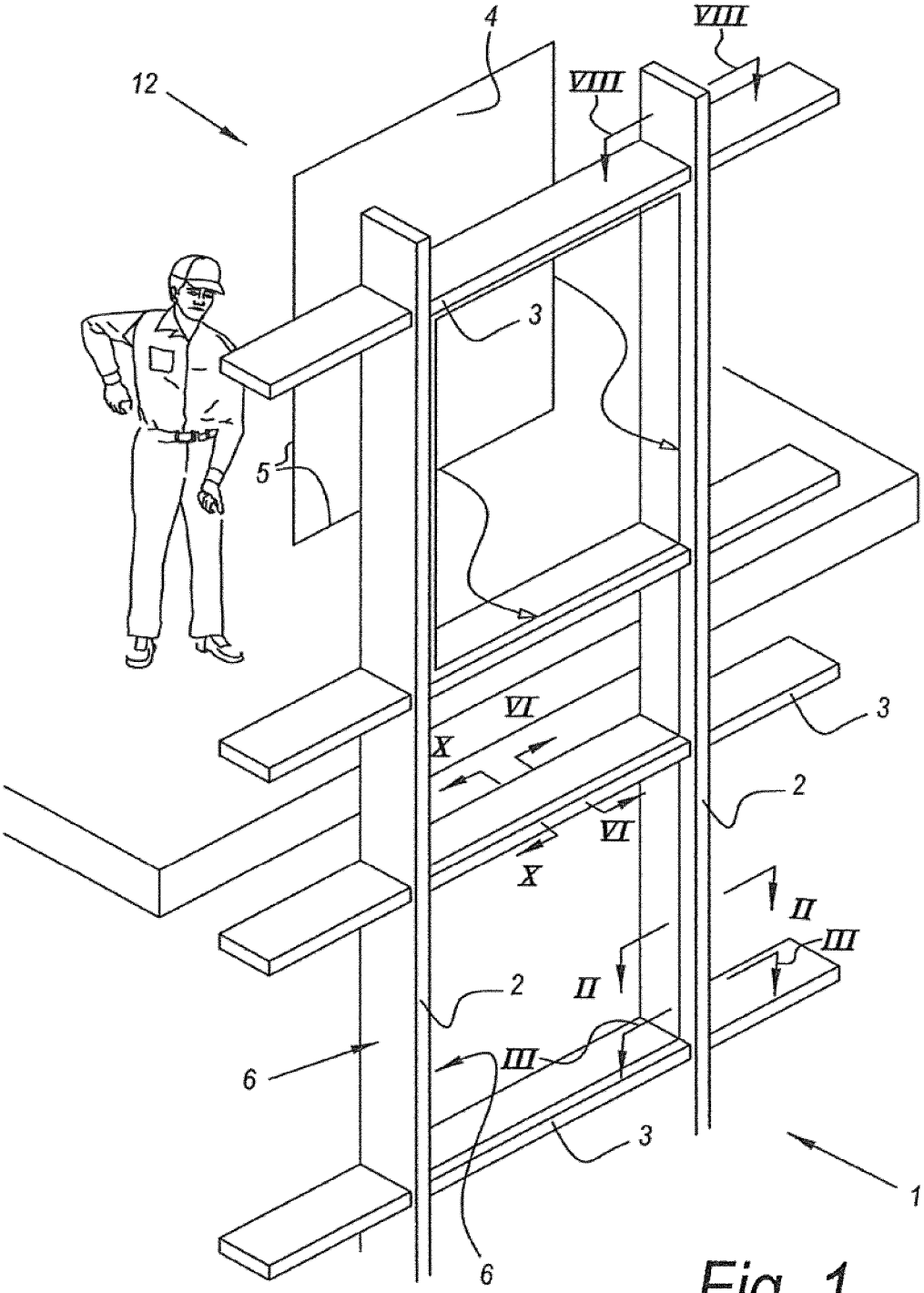
FIG. 1 shows a curtain wall which illustrates some features of the invention, but does not form part thereof.

FIG. 1 shows a curtain wall 1 under construction. The curtain wall 1 comprises mullions 2 and transoms 3. Panels 4, such as glazing, are situated with their edges 5 in the mullions 2 and in the transoms 3. The mullions 2 extend vertically and the transoms 3 extend horizontally. In the example, this relates to profiles 2-3 which are delivered prefabricated to the construction site. The complete curtain wall 1, including panels 4, can be installed from inside.

Figure 2:
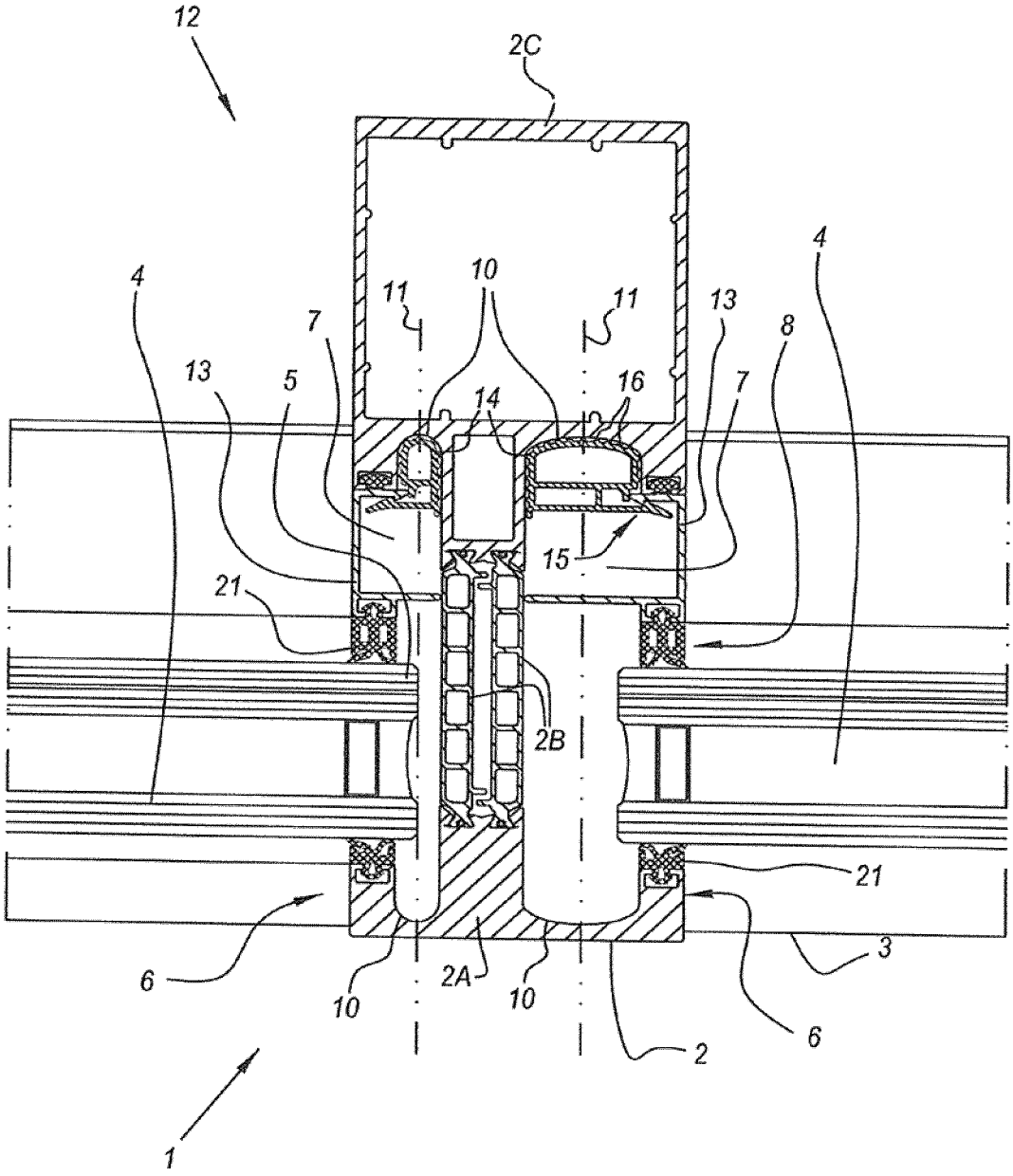
FIGS. 2 and 3 show, on a larger scale, a cross section according to the cutting lines II-II and III-III, respectively, shown in FIG. 1.

FIG. 2 shows that the mullions 2 are provided, on two opposite sides 6, with an undercut groove 7 with an access opening 8. The groove 7 forms a rebate into which the lateral edge 5 of the aforementioned panels 4 can be fitted. The transoms 3 extend horizontally between the two mullions 2. The illustrated mullions 2 comprise several part-profiles 2A-2B-2C fastened to each other, and not disassemblable from each other, including a part-profile 2B that forms a thermal break.

Figure 3:
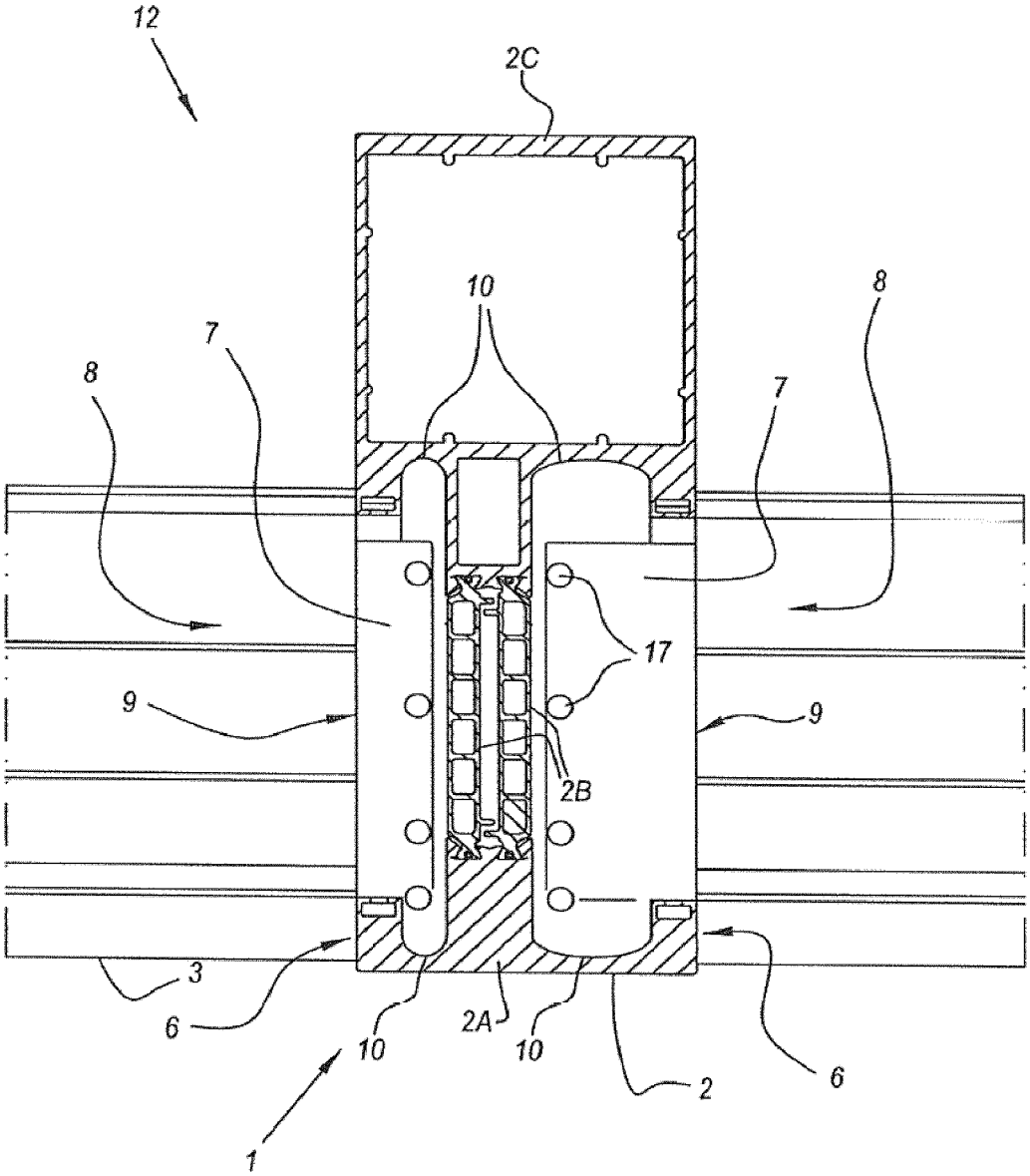

FIG. 3 shows that the ends of the transoms 3 are secured in the aforementioned grooves 7 of the mullions 2. To this end, head pieces 9 are fitted over the ends of the transoms 3.

The aforementioned undercut groove 7 has an elongate cross section which is provided with a rounded section at one or more of the transverse ends 10, and, in this case, is free from roundings with a radius smaller than 2 millimetres at the transverse ends 10. FIGS. 2 and 3 clearly show that the long axis 11 of the aforementioned elongate cross section is oriented transversely, or even perpendicularly, to the aforementioned panels 4.

As is shown in FIG. 2, the aforementioned panels 4 are fixed along the inside 12 of the curtain wall 1 by means of glazing beads 13 which are fastened to the aforementioned mullion 2, for example, as in this case, by means of attachment aids 14 to which the respective glazing beads 13 can be secured by means of mechanical locking means 15, more particularly attached or fixed, e.g., but not only, click-fitted or snap-fitted, preferably but not only as explained in more detail in WO 2017/201587. In the example, the attachment aids 14 are adhesively bonded to the mullion 2 at the location of the transverse end 10 of the undercut groove 7 which is located on the inside 12 of the curtain wall 1. In the example, the attachment aids 14 are provided with a surface with ribs 16 for this purpose, the tops of which come into contact with the surface of the respective transverse end 10, whereas there is space for receiving glue or some other cured fastening means between two adjacent ribs. The transverse ends 10 of the undercut groove 7 as such are free from irregularities, such as ribs.

It should be noted that the attachment aids 14 may be made as long or almost as long as the glazing beads 13 for which they are intended. Preferably, however, a glazing bead 13 is secured by means of several attachment aids 14 situated a distance apart, one above the other, for example three per glazing bead 13. Such an embodiment is an example of the second independent aspect mentioned in the introduction. For example, the attachment aids 14 may extend in each case over a distance of 2 to 20 cm, for example about 5 cm, in the mullion 2, with a distance between two adjacent attachment aids 14 of 10 to 50 cm, for example 20 to 30 centimetres.

FIG. 3 clearly shows that the aforementioned head pieces 9 have a geometry that is complementary to the cross section of the undercut groove 7 and, in the example, comes into contact with both transverse ends 10 thereof. As mentioned above, owing to said contact, a watertight and/or airtight connection is formed between the transom 3 and the mullion 2. Preferably, the contact between head piece 9 and undercut groove 7, such as here, is formed along the complete perimeter of the walls of the undercut groove 7.

Figure 4:
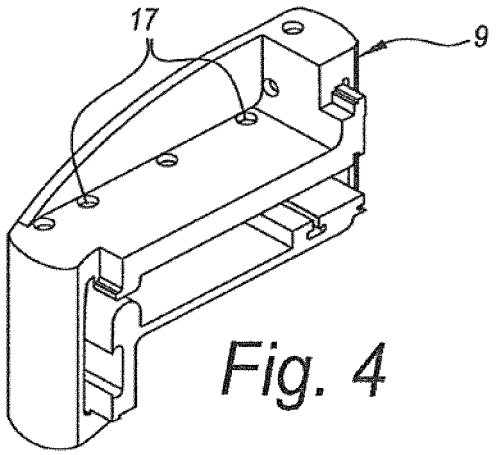
FIGS. 4 and 5 show head pieces in perspective which, according to the invention, can be fitted on the ends of the transoms.
Figure 5:
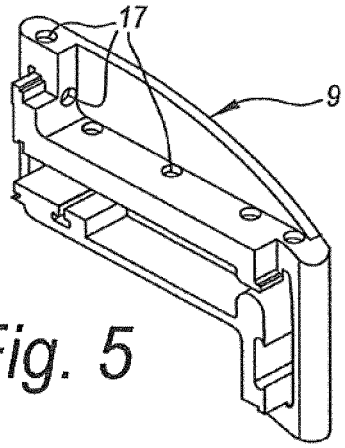

FIGS. 4 and 5 show a perspective view of the head pieces 9 used in FIG. 3. Said head pieces 9 comprise several openings 17 via which a sealing fastening means may be applied or injected. The fastening means is intended to provide a barrier to moisture which is situated on the transom 3 and which would otherwise find its way between the transom 3 and the head piece 9.

Figure 6:
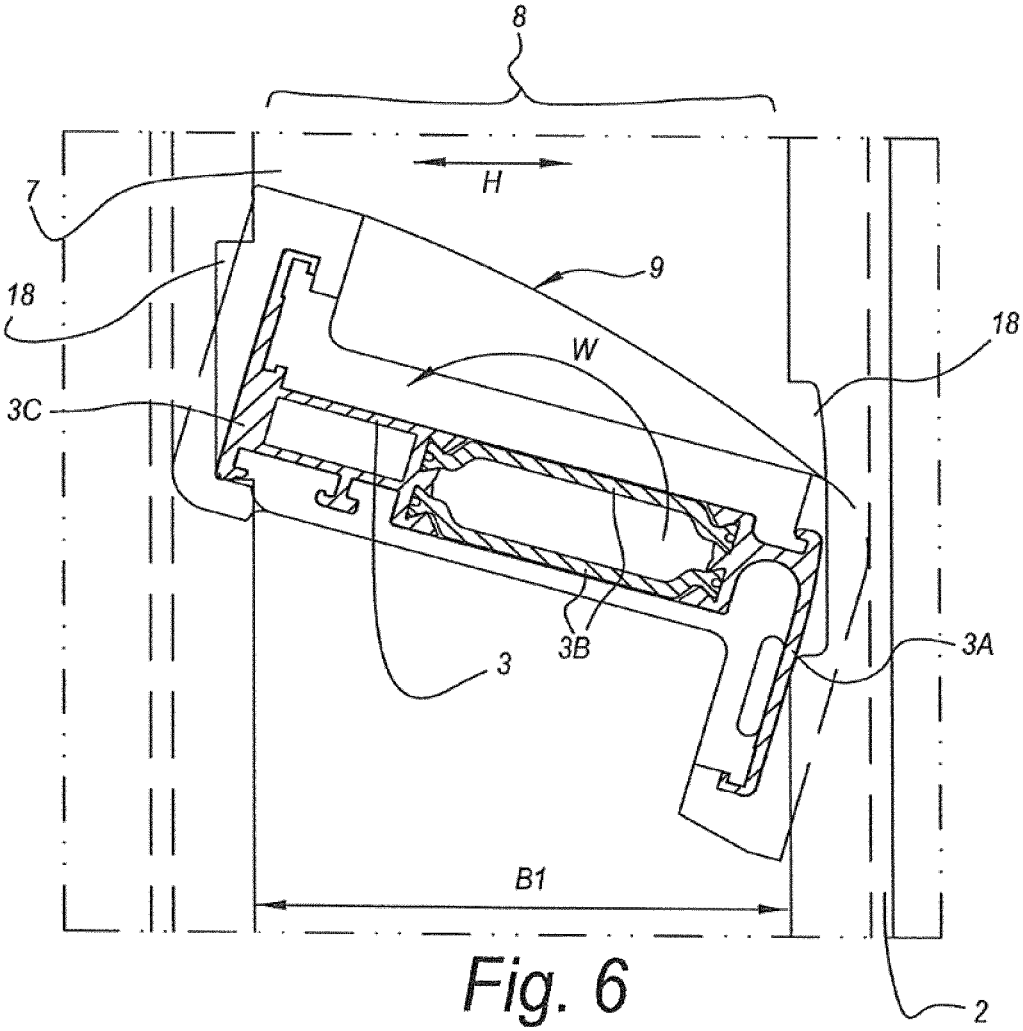
FIGS. 6 and 7 illustrate, in a cross section according to line VI-VI shown in FIG. 1, how the transom with the head pieces can be fitted in the undercut groove.

FIG. 6 shows that the transom 3 with the head piece 9 fitted thereon may initially be presented from the upper side and/or at an angle between two mullions 2, namely with the head piece 9 in the undercut groove 7. Then the transom 3 and the head piece 9 are turned, at the location of a recess 18 in the mullion 2, into the final position, shown in FIG. 7, for example in a manner similar to that described in more detail in WO 2017/201589. During this turning motion W, compression, preferably of the material of the head piece 9, may occur at the contact points between the respective head piece 9 and the undercut groove 7, so that the sealing effect at the connecting or fastening point between transom 3 and mullion 2 can be increased.

Figure 7:
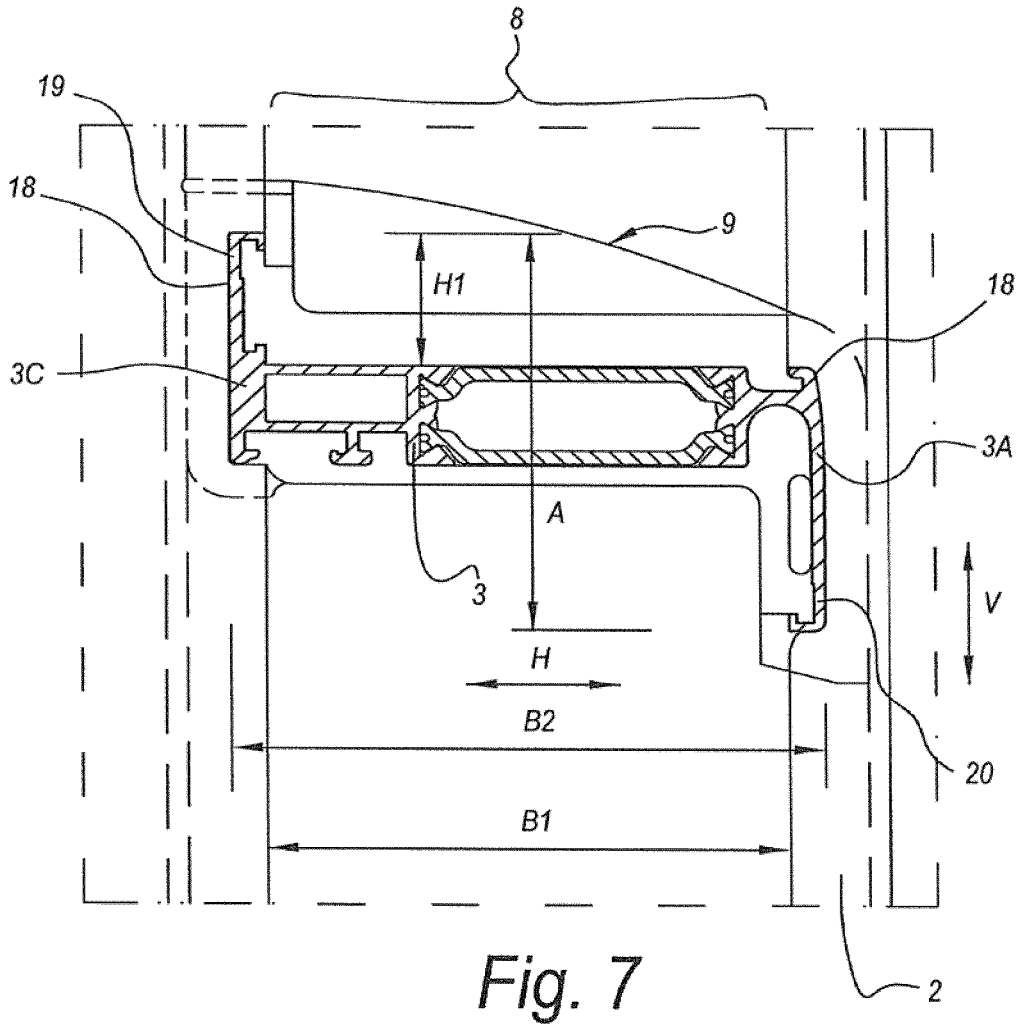

FIGS. 6 and 7 clearly show that the undercut groove 7 has an access opening 8, which has a width B1 in the horizontal direction H that is smaller than width B2 of the transoms 3 measured in the horizontal direction H and at right angles to the longitudinal direction of the transom 3. In a non-horizontal direction, for example in the vertical direction V, at right angles to the longitudinal direction, the transom 3 has a dimension A which is smaller than the width B1 of the access opening 8 of the undercut groove 7, so that the ends of the transoms 3, in a rotated state, for example the state in FIG. 6, pass through the access opening 8. Preferably, the transom 3, and/or the mullion 2, furthermore comprises means for locking the rotation of the transom 3 in the final position, for example that shown in FIG. 7. Although not shown here, it may be configured similarly to that explained in more detail in WO 2017/201589.

It is clear that the fitting of mullions 2 and transoms 3, and the installation of the panels 4, can be carried out completely without screws, and from the inside 12 of the building, while still achieving an airtight and/or watertight connection of mullions 2 and transoms 3. In this way, a field effect for water drainage, as mentioned in the introduction, is obtained.

FIGS. 6 and 7 furthermore also show that the transoms 3 comprise several part-profiles 3A-3B-3C which are fastened to each other and are not disassemblable from one another, including a part-profile 3B which forms a thermal break. Preferably, the transoms 3 are prefabricated, or, in other words, they are delivered to the construction site in the assembled state.

It is also clear from the example that the undercut grooves 7 on the opposite edges 6 of the mullions 2 preferably have a different depth. Such an embodiment allows the panels 4, such as panels 4 for glazing, to be arranged in the curtain wall 1 by means of a so-called shuffle technique, wherein one edge of the panel 4 is arranged in the deepest undercut groove 7, the panel is rotated in the plane of the glazing and is then pushed into the shallower undercut groove 7. The glazing is preferably fixed in its final position at least by means of the aforementioned glazing beads 13.

FIGS. 6 and 7 clearly show that the transoms 3 may be configured with at least a first leg 19 which projects upwards and which is situated on the inside of the transom 3, and preferably with a second leg 20 which projects downwards and which is situated on the outside of the transom 3. The one or more legs 19-20 provide additional bending strength of the profile. The first leg 19 preferably has a height H1 of 20 millimetres or more, so that there is only a risk of the water on the transom 3 moving inwards at a hydrodynamic pressure difference of 200 Pa.

Figure 8:
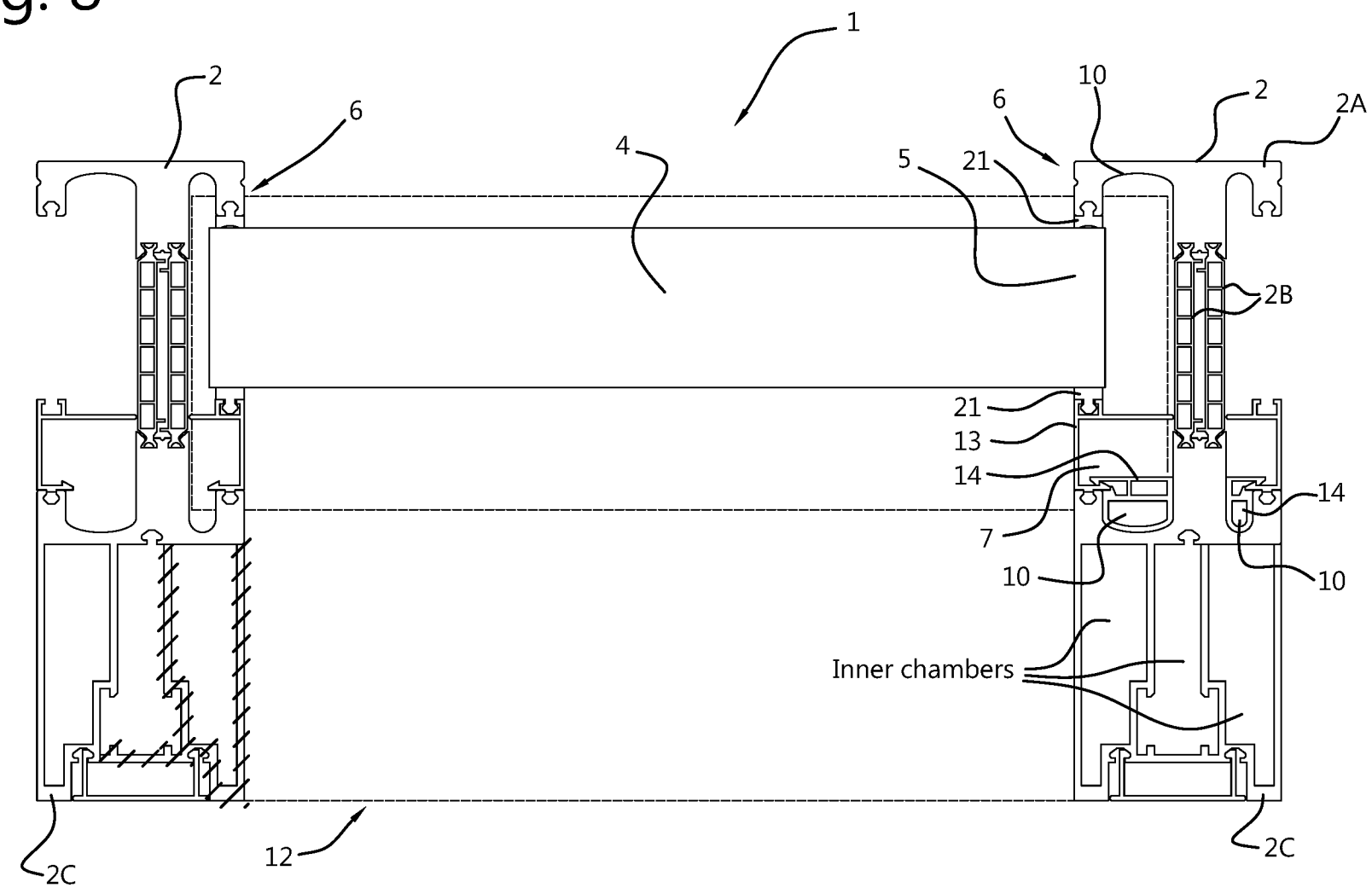
FIGS. 8 and 9 show, in a view similar to that of FIG. 2, for an embodiment according to the invention.
Figure 9:
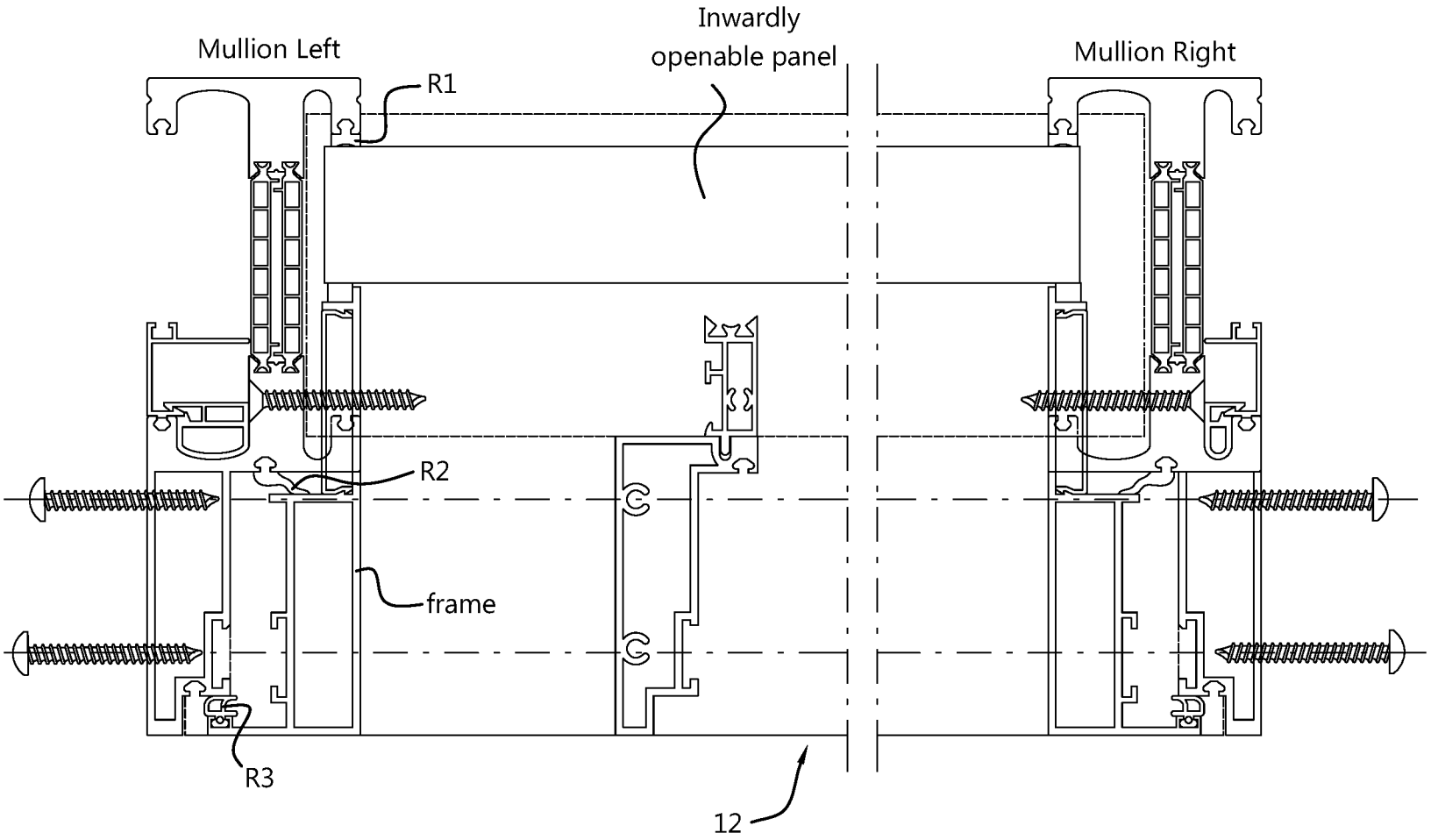
Figure 10:
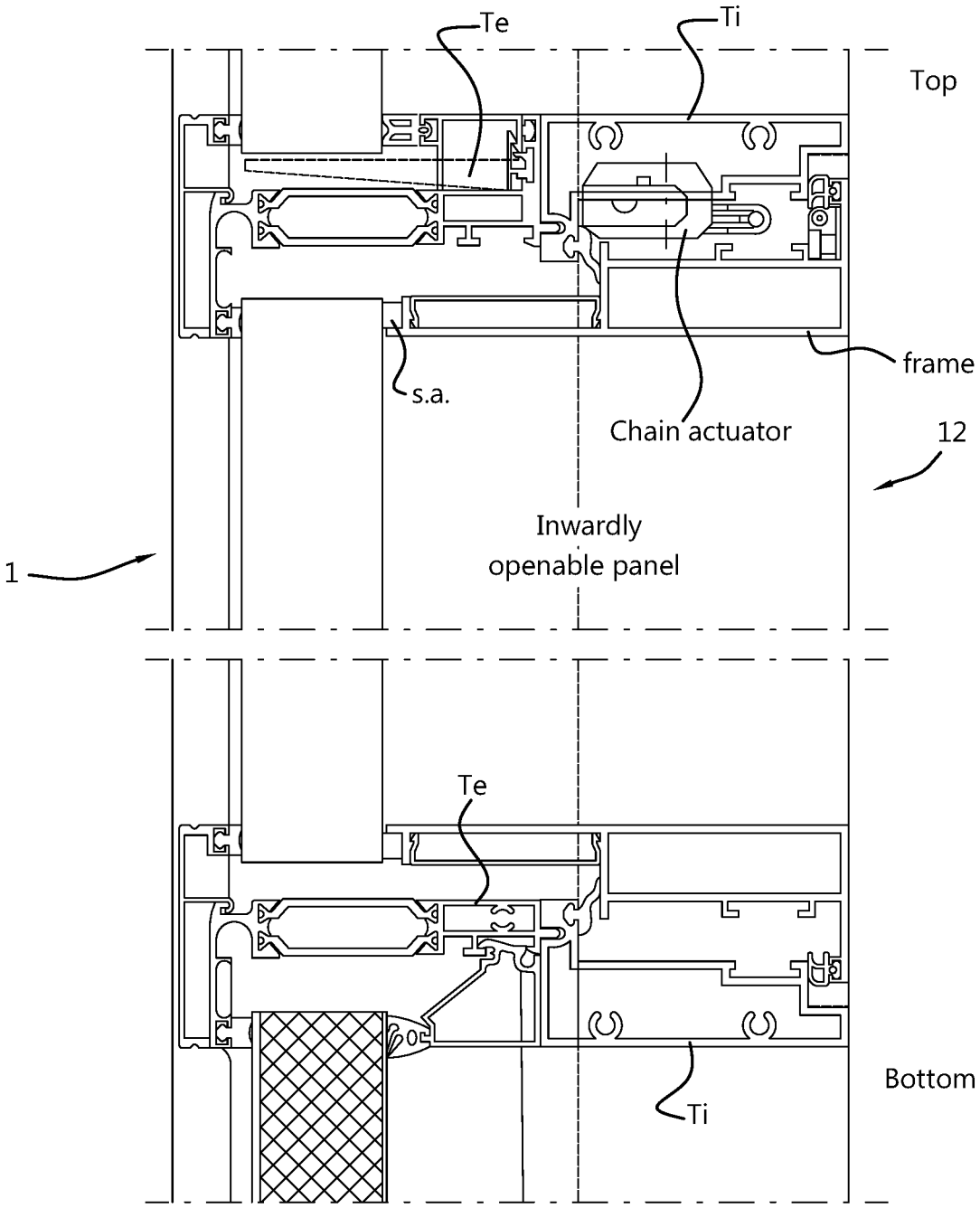
FIG. 10 shows, on a larger scale, a cross section, according to the line X-X shown in FIG. 1, of a curtain wall with the features of the invention.

FIG. 8 shows a curtain wall 1 with the features of the invention. Hatching serves to indicate that a wall of an inner chamber of the mullions can be removed. In this case, three inner chambers are provided. This makes it possible to locally remove the wall of an inner chamber on either side of the mullion while retaining the necessary structural integrity of the profile. FIG. 9 in turn shows that an openable frame may be installed at the location of the local adaptation. FIG. 10 shows a cross section of the respective transoms.

Furthermore, the following should be noted in connection with the invention and the figures:

At most of the conventional curtain wall systems, top hung windows opening to the outside can be integrated as well as all kinds of standard operable window systems. Both solutions are either functionally not what the building user would like to have, neither aesthetically what the architect is looking for.

The present invention allows for a curtain wall system, in particular of the continuous type, with inward opening windows, non-visible neither from the inside, neither from the outside of the building.

If the opening window is conceived as a tilt window with a fully invisible integrated chain actuator, the window does not even have a handle anymore and from the inside the window is almost not distinguishable—except a possible small gap along the perimeter between mullion/transom and vent—anymore from a fixed glazing.

The curtain wall of the invention and the installation thereof is extremely simple.

In the innovative solution, illustrated in FIGS. 8 to 10, the transom existing of 2 profiles can be installed as follows:

- Installation of exterior part (Te) of the transom, exactly the same way as for any other transom, as illustrated in FIG. 6
- Installation of the interior part of the transom (Ti) by a horizontal move where both transom parts are connected to each other by a water tight continuous tongue and groove joint connection
- Fixing of the lateral screws in the upper and lower transom and the mullions left and right
- Injection of the end pieces (FIGS. 4 and 5) as for the other transoms
- The glazed operable part is—with the use of a moveable installation table—moved just to the grid of mullions and transoms and the two scissor hinges (not shown) are connected to the operable part
- The chain actuator is connected
- The window is closed and installation is finished The obtained curtain wall allows for a perfect ventilation. No extra profiles are viewable, no handles are needed.

An extremely elegant window in a curtain wall is obtained, that in the same time allows for a top class solution from the ventilation point of view otherwise.

According to a preferred embodiment:

1. Click-fit bottom transom (as in FIG. 6).
2. Click-fit top transom.
3. Fit "inner" cavity of the transom by means of a horizontal movement (small slot at the front of the profile fits in the "nose" of the outer part) both at the top and bottom.
4. Fit screws into the bottom transom, both in the inner and outer cavity, by means of which this is fixedly screwed in between the mullions.
5. Fit screws in the top transom.
6. Inject the yellow end pieces in the bottom and top transom.
7. The glazed wing is fitted horizontally against the façade—by means of a fitting table—and at the bottom the 2 hinge linkages are attached to the wing.
8. The wing is almost closed and the chain of the electric motor is attached to the wing at the top.
9. Wing is closed and fitting is terminated.

The fitting of the façade therefore takes place in an identical manner to that of the base façade of WO'588.

Some further explanation:

1. See drawing of FIG. 8, the inner part of the mullion of the façade is different to that of the normal mullion.
2. Transom consists of an inner part Ti and an outer part Te.
3. The tube section on the inside is conceived so that milling away a zone (see hatched part near the mullion on the left in the drawing) creates both a chamber analogous to a classic window consisting of an outer frame and a wing frame, but in this case, the outer chamber is formed by the part of the mullion which is retained.

A wing frame and an outer frame are thus created, not by adding "something", but by milling away a part of the mullion.

This has several advantages:

a. The mullion is only milled away across the height where necessary or=across the height of the wing (=openable panel), which is de facto always in the viewing zone. This implies that the mullion remains intact and thus retains its full rigidity in the parapet zone which is usually subjected to considerable loads. In this way, bending of the mullion is reduced as much as possible.
   b. Can be applied both on the left and on the right.
   c. More economical since no separate outer frame is required to suspend the wing from.
   d. Much more elegant.

4. The openable unit is sealed in an airtight and watertight manner by means of 3 rubbers (see drawing B)—as is actually the case with every standard window concept.
   a. R1: is the normal standard rubber of our façade which in this case serves as a stop rubber.
   b. R2: the central seal which is preferably vulcanised in the corners in order to ensure a perfect seal.
      This central seal is fitted in a groove which extends vertically in the mullion, horizontally in the inner cavity Ti of the horizontal transom.
   c. R3: the inner rubber which serves as an acoustic seal.
5. The glazing (see drawing C) is adhesively bonded with structural silicone "SS or SG"—meaning structural silicone or structural glazing—along the entire periphery of the wing profile.

It should furthermore be noted that where an inside 12 of a curtain wall 1 is mentioned above, this is understood to refer to that portion of the curtain wall 1, namely of the transoms 3 and the mullions 2, which is directed to the inside of the building. This inside 12 does not necessarily only start at the most inwardly directed surface of the curtain wall 1 but starts behind the glazing surface.

The present invention is by no means limited to the above-described embodiments, but such curtain walls may be produced without departing from the scope of the present invention.

The invention claimed is:

1. A curtain wall comprising one or more mullions and one or more transoms,
wherein the one or more mullions extend vertically,
wherein the one or more mullions are composed of at least an inner profile and an outer profile connected by means of one or more plastic profiles,
wherein the inner profile, the outer profile and the one or more plastic profiles cannot be disassembled from one another,
wherein the one or more mullions are provided on two opposite sides with a groove with an access opening,
wherein the one or more transoms extend horizontally between two mullions and their ends are inserted in the grooves of these two mullions,
wherein the curtain wall includes at least an inwardly openable panel,
wherein the openable panel is installed between two mullions,
wherein the two mullions adjacent to the openable panel comprise one or more inner chambers in their inner profile,
wherein the two mullions adjacent to the openable panel are locally adapted for the installation of the openable panel,
wherein the local adaptation of the two mullions adjacent to the openable panel comprises at least the removal of a laterally directed wall of the inner chamber of each of the two mullions along a height of the openable panel, and
wherein the openable panel is installed in the local adaptation of the two mullions adjacent to the openable panel such that, when the openable panel is closed, the openable panel is not distinguishable from a fixedly fitted panel, neither from an inside nor from an outside of the curtain wall.

2. The curtain wall according to claim 1, wherein head pieces are fitted on the ends of the transoms, wherein the head pieces are inserted in the grooves of the mullions, wherein the head pieces have a geometry that is complementary with a cross section of the grooves such that a watertight and/or airtight connection is formed between the transoms and the mullions.

3. The curtain wall according to claim 1, wherein two of the transoms adjacent to an openable panel are fixed to the two mullions adjacent to the openable panel by means of screws.

4. The curtain wall according to claim 1, wherein the curtain wall furthermore comprises at least one fixedly fitted panel.

5. The curtain wall according to claim 1, wherein the fixedly fitted panel is a fixedly fitted window and comprises glazing.

6. The curtain wall according to claim 1, wherein the inner profile of the mullions consists essentially of steel or aluminum.

7. The curtain wall according to claim 3, wherein lateral edges of the fixedly fitted panels are at least inserted in the grooves of the mullions.

8. The curtain wall according to claim 3, wherein the openable panel is an openable window and comprises an openable frame, wherein glazing is fixedly fitted in or on the openable frame.

9. The curtain wall according to claim 3, wherein an outer side of the openable panel is situated in the same or virtually the same plane as an outer side of the fixedly fitted panel.

10. The curtain wall according to claim 8, wherein the glazing of the openable window is situated in the same or virtually the same plane as a glazing of the fixedly fitted panel.

11. The curtain wall according to claim 1, wherein the transom is also composed of at least an inner profile and an outer profile connected by means of one or more plastic profiles.

12. The curtain wall according to claim 1, wherein the inwardly openable panel comprises at least one of:
a tilt window with a handle;
a tilt window without a handle, suitable to be operated by means of an actuator;
a turn window;
a tilt/turn window;
a parallel inwardly opening window.

13. The curtain wall according to claim 1, wherein at least one of the transoms comprises an actuator for automatically opening the respective openable panel.

14. The curtain wall according to claim 1, wherein the transoms comprise an exterior part and an interior part, wherein the exterior part extends horizontally between two mullions, wherein head pieces are fitted on the ends of the exterior part, wherein the ends of the exterior part and the head pieces are inserted in the grooves of these two mullions, wherein the interior part is connected to the exterior part on the inside of the curtain wall, wherein the actuator is located in the interior part of the transom directly above the openable panel.

15. A method for the installation of an openable panel in a curtain wall,
wherein the curtain wall comprises one or more mullions and one or more transoms,
wherein the one or more mullions extend vertically,
wherein the one or more mullions are composed of at least an inner profile and an outer profile connected by means of one or more plastic profiles,
wherein the inner profile, the outer profile and the one or more plastic profiles cannot be disassembled from one another, wherein the one or more mullions are provided on two opposite sides with a groove with an access opening, wherein the one or more transoms extend horizontally between two mullions and their ends are inserted in the grooves of these two mullions, the method comprising the steps of:

creating a local adaptation in two adjacent mullions, wherein the two adjacent mullions comprise one or more inner chambers in their inner profile, wherein the local adaptation comprises at least the removal of a laterally directed wall of the inner chamber of each of the two mullions along a height of the openable panel;

installing the openable panel between the two adjacent mullions, wherein the openable panel is installed in the local adaptation of the two mullions adjacent to the openable panel such that, when the openable panel is closed, the openable panel is not distinguishable from a fixedly fitted panel, neither from an inside nor from an outside of the curtain wall.

* * * * *